US006666603B1

(12) United States Patent
Suzuki et al.

(10) Patent No.: US 6,666,603 B1
(45) Date of Patent: Dec. 23, 2003

(54) IMAGE FORMING APPARATUS

(75) Inventors: Kenji Suzuki, Mishima (JP); Seiichiro Kameda, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 09/696,008

(22) Filed: Oct. 26, 2000

(30) Foreign Application Priority Data

Oct. 29, 1999 (JP) ..... 11-308982
Sep. 29, 2000 (JP) ..... 2000-298403

(51) Int. Cl.[7] ..... B41J 13/10
(52) U.S. Cl. ..... 400/625; 400/642
(58) Field of Search ..... 400/625, 624, 400/626, 642, 645; 399/124, 367, 373, 374, 401, 402, 411; 347/111

(56) References Cited

U.S. PATENT DOCUMENTS

| | | | | |
|---|---|---|---|---|
| 4,851,876 A | * | 7/1989 | Yamamoto et al. | 355/323 |
| 4,978,980 A | * | 12/1990 | Noguchi et al. | 347/111 |
| 5,103,267 A | * | 4/1992 | Wada et al. | 355/321 |
| 5,448,348 A | | 9/1995 | Azeta | 355/319 |
| 5,839,032 A | * | 11/1998 | Yasui et al. | 399/124 |
| 5,913,015 A | | 6/1999 | Watanabe et al. | 395/111 |
| 5,937,260 A | * | 8/1999 | Taninaka et al. | 399/401 |
| 5,937,261 A | * | 8/1999 | Shirakawa et al. | 399/401 |
| 5,974,298 A | * | 10/1999 | Urban et al. | 399/401 |

FOREIGN PATENT DOCUMENTS

| | | |
|---|---|---|
| EP | 0 295 612 | 12/1988 |
| EP | 0 848 302 A2 | 6/1998 |
| EP | 0 892 323 A2 | 1/1999 |
| JP | 5-100599 | 4/1993 |

OTHER PUBLICATIONS

* Patent Abstracts of Japan; Publication No. 05100599; Publication Date Apr. 23, 1993.

* cited by examiner

*Primary Examiner*—Andrew H. Hirshfeld
*Assistant Examiner*—Anthony H. Nguyen
(74) *Attorney, Agent, or Firm*—Fitzpatrick, Cella, Harper & Scinto

(57) ABSTRACT

An image forming apparatus, which improves the stacking ability of a sheet and prevents contamination of an image formed surface at a low cost, includes a frame, an image forming portion forming an image on the sheet, a first conveying path through which the sheet on which the image is formed by the image forming portion is conveyed, a sheet discharge tray provided outside the frame and onto which the sheet conveyed through the first conveying path is discharged so as to be accommodated on the sheet discharge tray. A sheet discharging roller rotatable in a direction of discharges the sheet onto the sheet discharge tray in a reverse direction thereof. A second conveying path extends downwardly inside the frame from the first sheet discharging roller as an end of the second conveying path, with a section thereof formed in substantially an S-shape, in which the second conveying path conveys the sheet P conveyed in the direction of discharging from the first conveying path onto the sheet discharge tray by the first sheet discharging roller and pulled into the frame by reversely rotating the first sheet discharging roller during discharging.

11 Claims, 10 Drawing Sheets

IMAGE FORMING APPARATUS

BACKGROUND OF THE INVENTION

1. Field of the Invention

The present invention relates to an image forming apparatus having a configuration for preventing faulty stacking of recording sheets.

2. Related Background Art

A conventional image forming apparatus will be described with reference to the drawings. FIG. 9 is a view showing an entire conventional image forming apparatus and FIG. 10 is a view for explaining a movement of a sheet at a sheet discharging portion.

In recent years, the image forming apparatus has been widely used such as a copying machine, a printer or a facsimile, which has a configuration based on a copying machine. However, a recent rapid prevalence of a personal computer has been bringing the configuration to be mainly based on the printer.

When the image forming apparatus has a configuration based on a printer, as shown in FIG. 9, it is typical to provide a sheet discharge tray 106 on which sheets recorded are discharged above the image forming portion 102 and to discharge the sheets with their image-formed surfaces downward (facedown) so as to be in page order. In the case of using the apparatus as a copying machine, it is possible to form it to be an inside apparatus sheet discharging type copying machine by providing an image reading portion (reader portion) spaced above the discharge tray 106.

In this image forming apparatus, a toner image is transferred onto the sheet P fed from a sheet discharging portion 101 at the image forming portion 102, and fixed by having the sheet P on which the toner image has been transferred passed through a fixing portion 103. Then, the sheet P is generally discharged from a pair of first discharging rollers 104, 105 to the sheet discharge tray 106.

In case of fitting a post-treatment apparatus 109 such as a sorter or a finisher to the image forming apparatus, the recording sheet P is conveyed in a reverse direction (a direction of the post-treatment apparatus 109) with its rear end nipped by the pair of first discharging rollers 104, 105, and fed from a pair of second discharging rollers 107, 108 provided in the image forming apparatus to a conveying roller in the post-treatment apparatus 109 to be subjected to a predetermined post-treatment.

In an image forming apparatus called a complex machine serving functions of a copying machine, a printer and a facsimile together, by fitting the post-treatment apparatus 109 as shown in FIG. 9, it is obviously possible to sort the sheets such that a copy output sheet is sorted into a bin 109*a*, a printer output sheet into a bin 109*b* and a facsimile output sheet into a bin 109*c* to be output.

However, the above described image forming apparatus has following problems.

As described above, when the post-treatment apparatus 109 is mounted on the image forming apparatus, the front end of the sheet P fed to the post-treatment apparatus 109 is discharged on the sheet discharge tray 106, and then, conveyed in the direction of the post-treatment apparatus 109 by reversely rotating the pair of first discharging rollers 104, 105 at a predetermined timing to turn over the conveying direction.

In this case, when the recording sheet P is to be fed to the post-treatment apparatus 109 as shown in FIG. 10, the front end of the recording sheet P (or the rear end when being conveyed in the direction of the post-treatment apparatus) trails in contact with the recording sheet already stacked on the sheet discharge tray 106 so that there is a possibility of the sheet already discharged being bent or damaged. In addition, the sheet P is discharged with the image formed surface downward (so-called, facedown) so that such trailing is likely to cause the image-formed surface to be rubbed and thereby to be contaminated.

In order to prevent such lowering of stacking ability, when the sheet conveyed in the direction of the post-treatment apparatus 109 is discharged on the sheet discharge tray 106, the sheet is temporality discharged onto a position different from the sheet discharge tray 106, or a spare tray is arranged for only turning over the sheet. Adopting these configurations, however, further requires a space into which the sheet is temporarily discharged or a component such as the spare tray, thereby raising an apparatus cost and making the apparatus larger in size.

SUMMARY OF THE INVENTION

The present invention is achieved in view of the above-mentioned problems and has as its object to provide an image forming apparatus which improves the stacking ability of sheets and prevents contamination of an image formed surface at a low cost. The image forming apparatus comprises: a frame; a first conveying path through which the sheet on which the image is formed by the image forming means is conveyed; a sheet discharge tray provided outside the frame and onto which the sheet conveyed through the first conveying path is discharged so as to be accommodated on the discharge tray; a first sheet discharging roller rotatable in a direction of discharging the sheet onto the sheet discharge tray and in a reverse direction thereof; and a second conveying path extending downwardly inside the frame from the first sheet discharging roller as a first end, with a section thereof formed in a substantially S-shaped; the second conveying path conveying the sheet conveyed in the direction of discharging from the first conveying path onto the sheet discharge tray by the first sheet discharging roller and pulled in the frame by reversely rotating the first sheet discharging roller during discharging.

Objects and characteristics of the present invention other than the same described above will be clearly described below in detail concerning the mode of the present invention with reference to the drawings.

DESCRIPTION OF THE PREFERRED EMBODIMENTS

Figure 1:
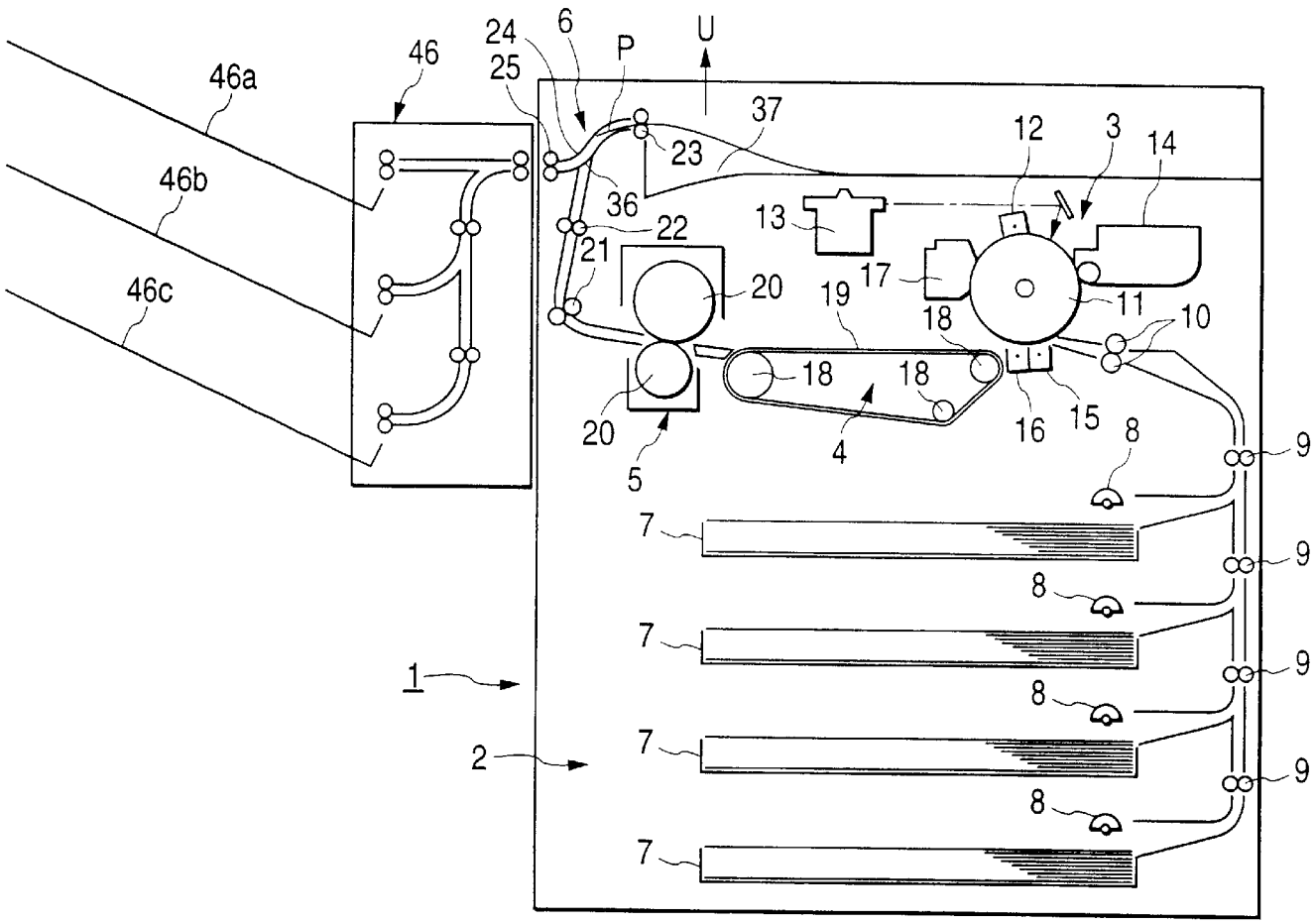
FIG. 1 is a schematic sectional view of an image forming apparatus according to an embodiment of the present invention.

An image forming apparatus according to the present invention will be described with reference to the drawings. The image forming apparatus in this embodiment is of a type discharging a sheet on which an image is formed onto a sheet discharging tray at an upper surface of the apparatus face-down. A post-treatment apparatus illustrated as an example is the one to be mounted on a side of an apparatus body.

Image forming in this image forming apparatus is of an electrophotographic type in which a toner image is transferred onto a sheet. However, the present invention is not limited to this and is applicable to image forming of an ink jet recording type injecting ink to form the image or of an heat transferring type.

First, a summary of a configuration and movement of the image forming apparatus will be described by using FIG. 1. In an image forming apparatus body 1, there are provided a sheet feeding portion 2 stacking and accommodating sheets on which images are to be formed and for feeding sheets to a image: forming portion 3 one by one, the image forming portion 3 forming the image on the sheet, a conveying portion 4 further conveying the sheet on which the image is transferred, a fixing portion 5 substantially permanently fixing the image of the sheet conveyed, a sheet discharging portion 6 discharging the sheet on which the image is fixed out of the apparatus, and a post-treatment apparatus 46 carrying out a predetermined post-treatment on the sheet on which the image is formed. The configuration of each part of the apparatus 1 will be described in detail.

(Sheet Feeding Portion)

The recording sheet P accommodated in a sheet cassette 7 arranged at a lower portion of the apparatus body 1 is fed out in a direction of a conveying roller 9 by rotating a pickup roller 8 in contact with the sheet. The sheets P fed out by the pickup roller 8 are separated into one sheet by not-shown separating means (for example, a separating nail, a separating pad or a reversely rotating roller), and conveyed to a pair of registration rollers 10 provided near an inlet of the image forming portion 3 by a pair of conveying rollers 9.

The pair of registration rollers 10 straighten an attitude of the sheet P conveyed and bring the sheet to a temporary stop in order to adjust an image forming timing to be matched with the image forming portion 3. The sheet, the skew feeding of which is corrected by the pair of registration rollers 10, and adjusted to be in exact timing with the image forming portion 3 is conveyed to the image forming portion 3 by the rotation of the pair of registration rollers 10.

(Image Forming Portion)

In the image forming portion 3 of the electrophotographic type, there are provided a laser scanner 13 irradiating laser based on an image data input in the apparatus, a photosensitive drum 11 as an image holder, a primary charging device 12 evenly charging a surface of the photosensitive drum 11, a developing device 14 visualizing the image by having the toner absorbed by an electrostatic latent image formed on the photosensitive drum 11, a transferring charging device 15 transferring a toner image formed on the photosensitive drum 11 onto the sheet P, a separating charging device 16 separating the sheet P on which the toner image is transferred from the photosensitive drum 11, a cleaning device 17 removing the toner remaining on the photosensitive drum 11 and cleaning the photosensitive drum 11 for the next image forming movement.

When the image forming movement is started, the surface of the photosensitive drum 11 is evenly charged by the primary charging device 12. The image data is written in the charged photosensitive drum 11 by the laser irradiated by the laser scanner 13, whereby the electrostatic latent image is formed on the photosensitive drum 11.

By means of the developing device 14, the toner is absorbed by the photosensitive drum 11 on which the electrostatic latent image is formed, whereby the toner image to be transferred onto the sheet is formed on the surface of the photosensitive drum 11.

The toner image formed on the photosensitive drum 11 by the transferring charging device 15 is transferred onto the sheet P conveyed from the pair of registration rollers 10 in adjusted timing such as to be synchronized with the above image forming movement, and the sheet P is separated from the photosensitive drum 11 by the separating charging device 16 provided immediately behind a downstream side in a conveying direction of the transferring charging device 15. The extra toner or the like remaining on the surface of the photosensitive drum 11 is removed by the cleaning device 17, and the photosensitive drum 11 gets ready for the next image forming movement.

(Conveying Portion)

The sheet P separated from the photosensitive drum 11 by the separating charging device 16 of the image forming portion 3 is further conveyed in further downstream direction by the conveying portion 4 provided at the downstream side in the sheet conveying direction of the photosensitive drum 11. The conveying portion 4 is provided with a belt 19 wound around a conveying roller 18, and the sheet P on which the toner image is transferred is loaded on the belt 19 to be conveyed to the fixing portion 5 at the downstream side.

(Fixing Portion)

In the fixing portion 5, the sheet P on which the toner image is transferred is nipped and supported by the pair of fixing rollers 20 heated by,means of a heater (not shown), and the toner is melted and substantially permanently fixed on the surface of the sheet by heating and pressing the sheet. After the fixing, the sheet P is fed to the sheet discharging portion 6.

(Sheet Discharging Portion)

The sheet P having passed through the pair of fixing rollers 20 is conveyed by a pair of conveying rollers 21, 22 to be discharged onto the sheet discharge tray 37 formed on the upper surface of the apparatus body 1 by the pair of discharging rollers 23. In the case where the post-treatment apparatus 46 is arranged on the side of the apparatus body 1, as disclosed in the description of the prior art, the conveying direction of the sheet is turned over, with the sheet P nipped only by the pair of discharging rollers 23, by a reversely conveying means (not shown) such as a motor forwardly and reversely rotatable, and the sheet is conveyed in a direction of a conveying path 24 connecting with the post-treatment apparatus 46. At this time, a flapper 36 prevents the sheet P conveyed in the direction of post-treatment apparatus 46 from entering in the direction of the pair of fixing rollers 20.

The sheet P having passed through the conveying path 24 and reached to a pair of post-treatment discharging rollers 25 is fed into the post-treatment apparatus 46 by the rollers 25, and after the predetermined post-treatment, discharged onto any one of post-treatment discharge trays 46*a*, 46*b*, 46*c*.

(Post-Treatment Apparatus)

The post-treatment apparatus shown in the present embodiment is a sorter for sorting the sheets into predetermined bundles. However, the present invention is not limited to the kind of the post-treatment apparatus and is applicable to any kind of post-treatment apparatus such as one for stapling, stamping or punching. The post-treatment apparatus may be a double-sided unit in which the sheet is reconveyed from the post-treatment apparatus 46 into the image forming apparatus 1 to form images on both sides of the sheet.

When the double-sided unit is substituted for the post-treatment apparatus 46, the conveying direction of the sheet is turned over at the sheet discharging portion 6 before the sheet P is conveyed into the double-sided unit, so that there is no need for switching back the conveying direction of the sheet in the unit. For this reason, the images can be formed on both sides of the sheet if the unit is provided with a conveying opening for feeding the sheet through the inside of the post-treatment apparatus 46 to the image forming apparatus 1 and configured such that the sheet is reconveyed through the conveying opening to an upstream side of the pair of registration rollers 10 of the image forming apparatus.

Next, the characteristics of the present invention will be described in detail. As described with respect to the prior art, in the case where the image formed sheet P is temporarily discharged out of the apparatus to subsequently turn over the discharging direction, movement involved in turning over the sheet P is likely to have a bad influence on the sheet already stacked on the sheet discharge tray 37 or the turning-over sheet per se.

In the image forming apparatus according to the present invention, as shown in FIG. 1, the conveying path extending from the pair of discharging rollers 23 to the pair of post-treatment discharging rollers 25 is configured substantially in an S-shape. First, the rotating direction of the pair of discharging rollers 23 is turned over to the reverse direction with the sheet discharged in the direction of the sheet discharge tray 37 nipped by the pair of discharging rollers 23. At this time, the rear-end side of the sheet P (the side of the pair of fixing rollers 20) passes through the flapper 36, and the sheet is conveyed in the reverse direction to be led through the conveying path 24 and nipped by the pair of post-treatment discharging rollers 25. In this condition, the sheet between the pair of discharging rollers 23 and the pair of post-treatment discharging rollers 25 is bent substantially in an S-shape.

In other words, the sheet P conveyed in the reverse direction by the pair of discharging rollers 23 is conveyed along a guide curved in a vertical downward direction. The sheet P is then conveyed along a guide formed so as to be bent in an opposite direction of the curve to thereby be bent in an S-shape.

In addition, a sheet path is formed substantially in a parallel direction, through which the sheet P is conveyed from the pair of post-treatment discharging rollers 25 to the post-treatment apparatus. Such configuration causes tension at the end of the sheet P discharged onto the sheet discharge tray 37, and the sheet P is raised in an arrow U direction. This reduces contact between the sheet already stacked on the sheet discharge tray 37 and the sheet P conveyed in the reverse direction, thereby permitting prevention of trailing or contamination.

Figure 2A:
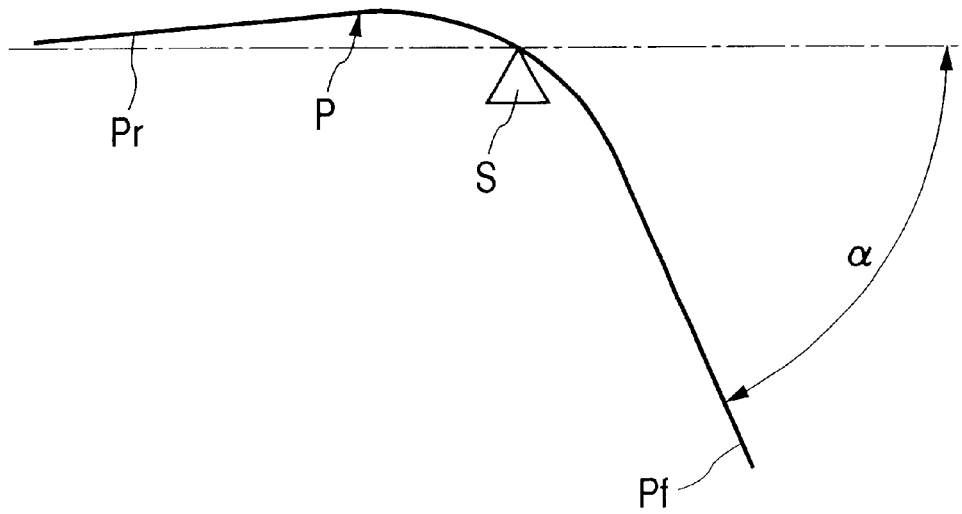
FIGS. 2A and 2B are views showing principle of condition of a sheet discharging portion.
Figure 2B:
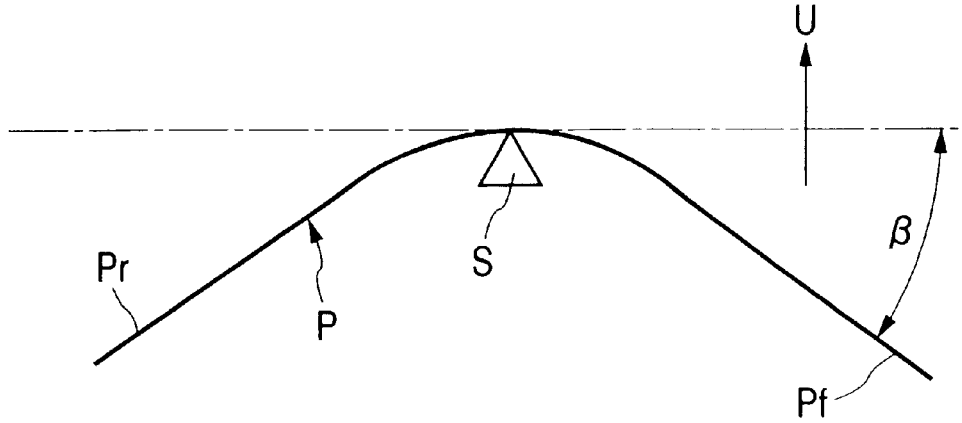

Next, a principle of obtaining the above-mentioned effect will be described in detail by using the drawings. FIGS. 2A and 2B show the condition where the sheet P is discharged from the pair of discharging rollers 104, 105 in the conventional image forming apparatus shown in FIG. 11, and the character P denotes a sheet and the character S denotes a fulcrum supporting the sheet P, hereafter referring to a pair of discharging rollers.

Therefore, FIGS. 2A and 2B show the principle of the conveying direction of the sheet when the conveying direction of the sheet discharged through the pair of discharging rollers 104, 105 out of the apparatus is turned over and the sheet is conveyed in the reverse direction. The character Pf denotes a front-end side of the sheet when the sheet is conveyed in the direction of discharging the sheet from the pair of sheet discharging rollers out of the apparatus and the character Pr denotes a rear-end side of the sheet. The characters Pf and Pr herein defined will be hereafter referred to as a front end and a rear end of the sheet, respectively, regardless of the direction of the sheet conveyed.

As shown in FIG. 2A, when the rear-end side Pr of the sheet P supported by the fulcrum S is raised substantially in parallel with the level (or horizontal) line, the sheet P is naturally bent with the fulcrum S, and an angle $\alpha$ is formed between the front-end side Pf and the level (or horizontal) line. As shown in FIG. 2B, however, when the rear-end side Pr of the sheet raised to be substantially parallel with the level line is lowered, the angle $\beta$ is formed between the end Pf and the level line because of the rigidity that the sheet P has, therefore it is clear that the angle $\alpha$ becomes greater than the angle $\beta$ ($\beta<\alpha$).

Namely, when the sheet P is temporarily discharged out of the apparatus with the sheet P nipped and supported by the pair of discharging rollers 104, 105 and the pair of discharging rollers 104, 105 is then reversely rotated to convey the sheet P in the reverse direction, it becomes possible to raise the front-end side Pf discharged out of the apparatus in a height direction of the fulcrum S (the arrow U) direction in the Figure) by selecting either conveying the rear-end side Pr of the sheet in a horizontal direction from the fulcrum S or in a direction of making the angle with the level line.

Figure 3:
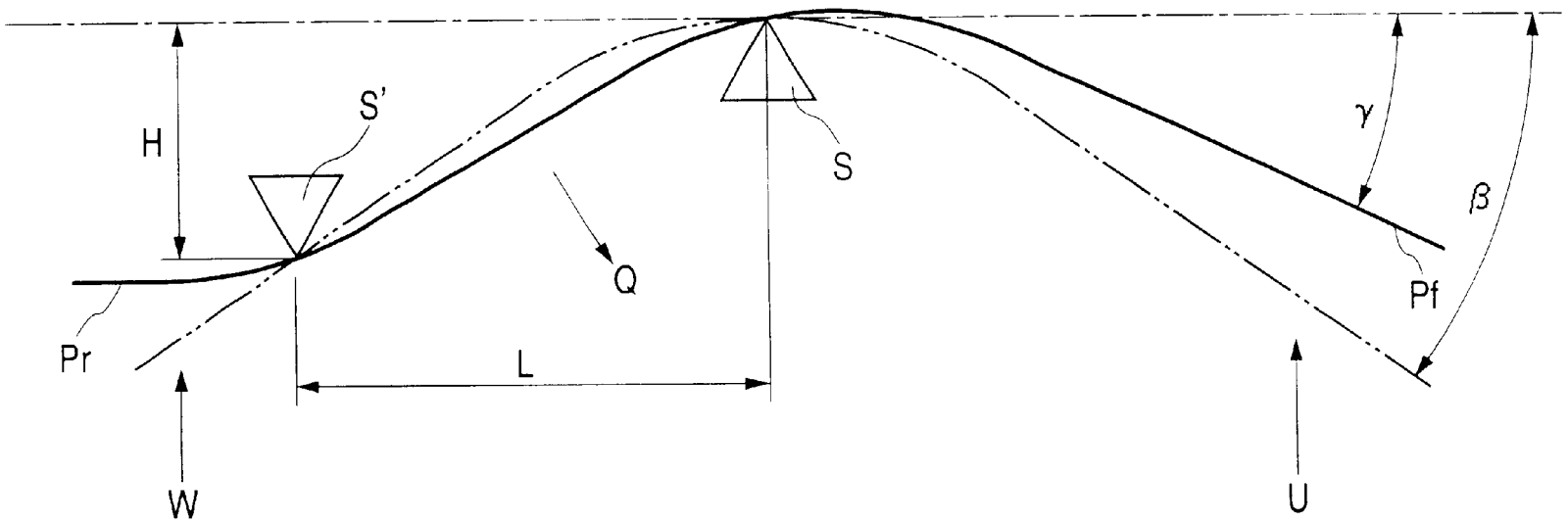
FIG. 3 is a view showing principle of a configuration of the sheet discharging portion of the present invention.
Figure 4:
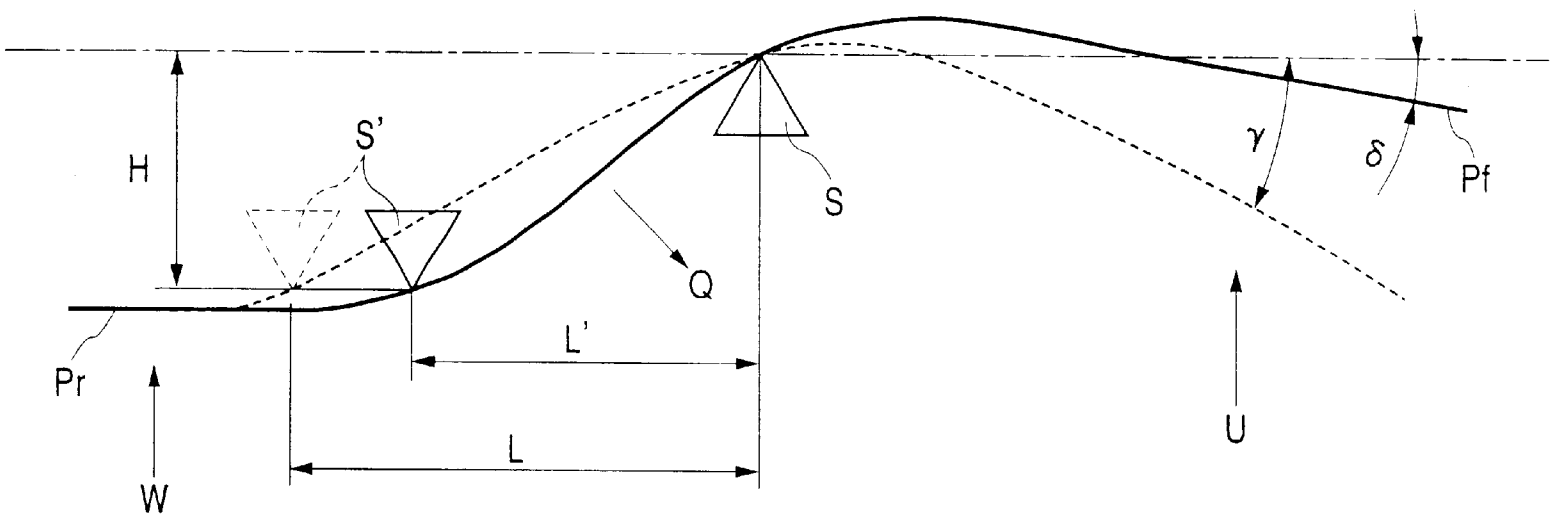
FIG. 4 is a view showing principle of a configuration of the sheet discharging portion of the present invention.
Figure 5:
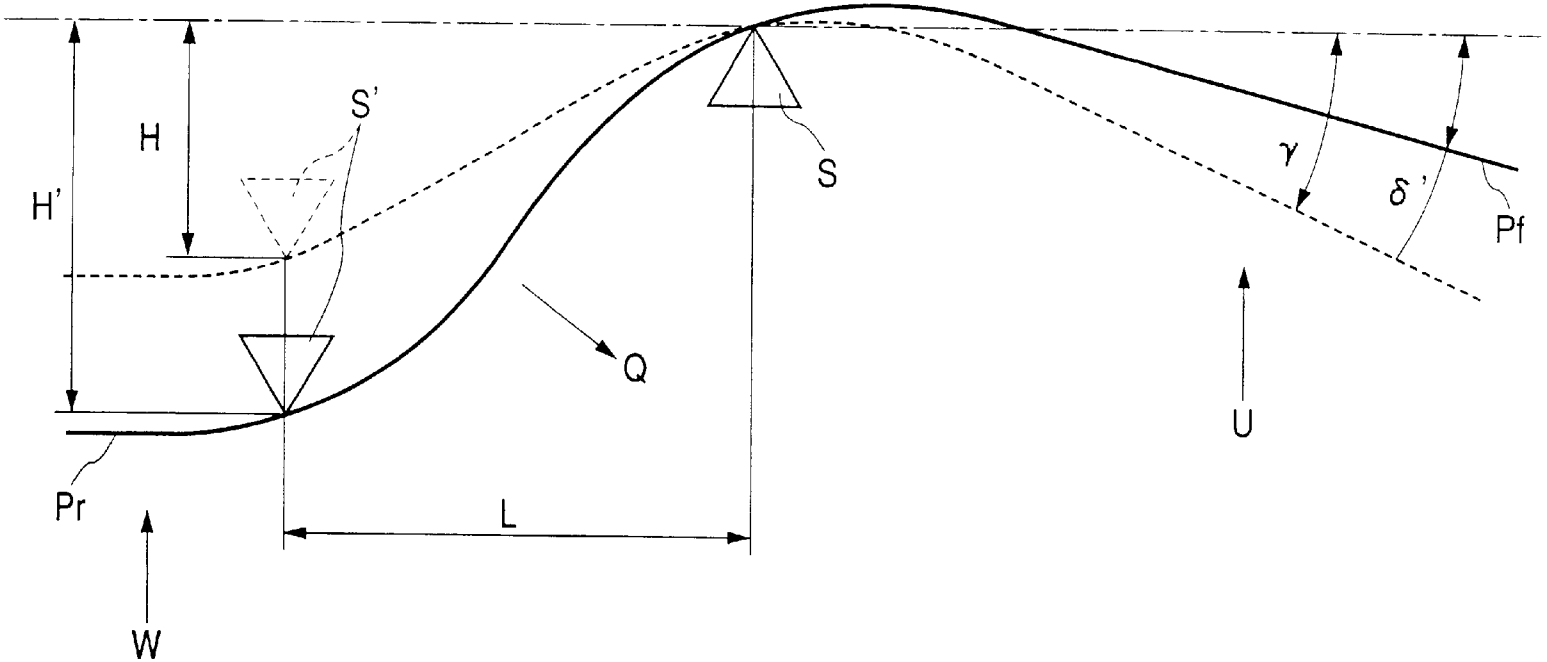
FIG. 5 is a view showing principle of a configuration of the sheet discharging portion of the present invention.

A description will be further made with respect to FIGS. 3 to 5. In FIG. 3, in case of conveying in the reverse direction such that the rear end Pr of the sheet is to be the front end in the conveying direction, a fulcrum S' is provided spaced from the fulcrum S at a parallel (or horizontal) distance L and a height distance H to bend the sheet P in S-shape. As shown in this drawing, the angle formed by the front-end side Pf of the sheet and the level line becomes $\gamma$ less than the angel $\beta$ as compared with FIG. 3 having one fulcrum.

When a fulcrum S' is provided and the sheet P is bent in an arrow W direction with the fulcrum S', the sheet between the fulcrums S and S' ifs pressed in an arrow Q direction. The sheet between the fulcrums S and S' is to be displaced in an arrow Q direction, so that the free end side Pf of the sheet P is subjected to the tension to be displaced upward (an arrow U direction).

FIG. 4 shows condition where the position of the fulcrum S' in a lateral direction shown in FIG. 3 is moved near the fulcrum S. The fulcrum S' is positioned at a distance L' from the fulcrum S (shown by a broken line in the drawing). A reduction in a space between the fulcrum S and the fulcrum S' results in an increase in an inclination between the fulcrums S and S', and depending upon it, also results in an increase in a force to try to deform the sheet between the fulcrums S and S' in the arrow Q direction. By this force, the force in the arrow U direction acts on the free end side Pf of the sheet P which is the opposite end of the sheet in respect of the fulcrum S, whereby the angle between the front-end side Pf of the sheet and the level (or horizontal) line may become δ less than the angle γ.

FIG. 5 shows the condition where the position of the S' in the height direction shown in FIG. 3 is lowered than that shown in FIG. 3. The distance between the fulcrums S' and S in the height direction is H' (H' is greater than H). In this condition, like the one shown in FIG. 4, the inclination between the fulcrums may be increased so that the angle formed by the front-end side Pf of the sheet and the level (or horizontal) line also becomes δ', which is less than γ (δ<γ).

In order to bend a sheet in an S-shape, therefore, the inclination between the fulcrums may be increased by decreasing the distance between the fulcrums and/or increasing the distance in height between the fulcrums and/or increasing the distance in height between the fulcrums, thereby easily increasing the force to try to displace in the arrow Q direction of the sheet positioned between the fulcrums. If this force is increased, the end Pf which is the free end side may be raised in height to be almost parallel with the level (or horizontal) line.

Figure 6:
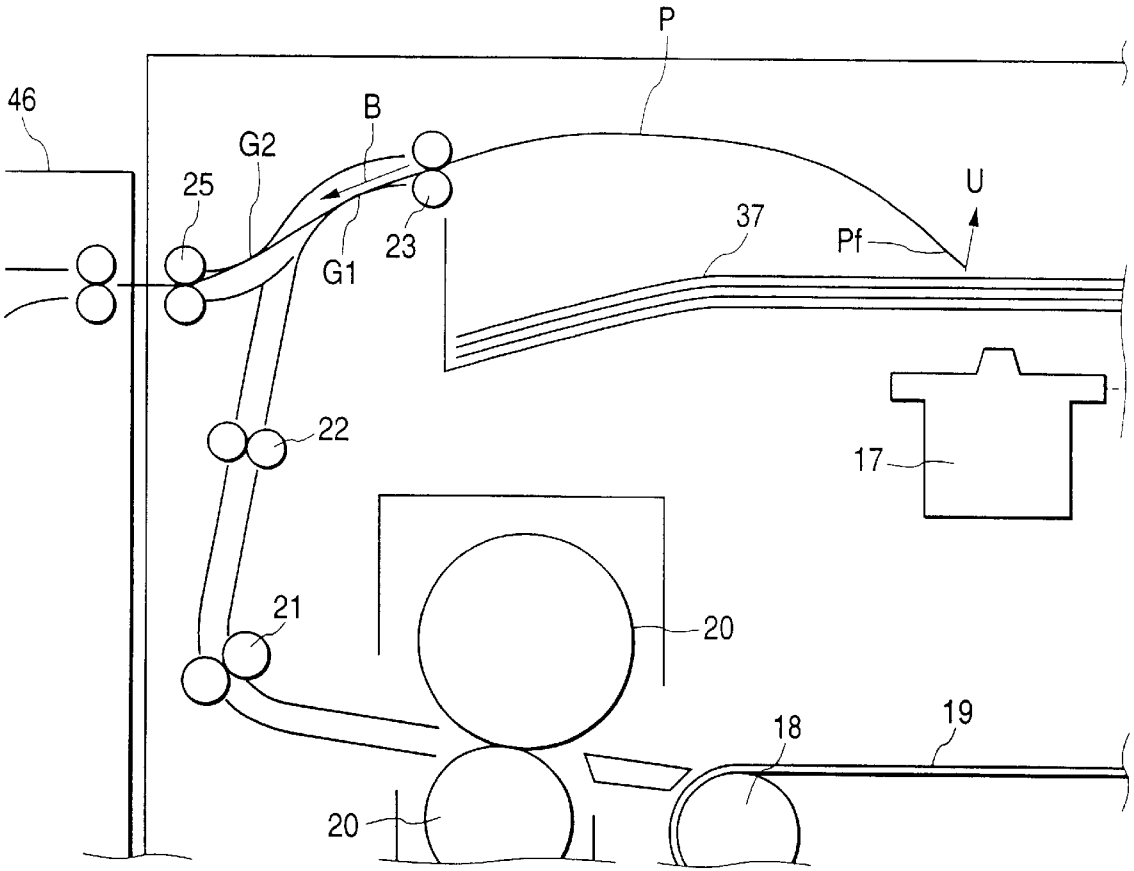
FIG. 6 is an enlarged view of the sheet discharging portion of the image forming apparatus according to the present invention.

In the image forming apparatus according to the present invention, based on the above-mentioned principle, the conveying path 24 through which the sheet is conveyed from the sheet discharge tray 37 to the post-treatment apparatus 46 is formed substantially in an S-shape as shown in FIGS. 1 and 6.

That is, the pair of discharging rollers 23 and the pair of post-treatment discharging rollers 25 are positioned lower than the pair of discharging rollers 23, and the conveying direction of the sheet conveyed from the pair of post-treatment discharging rollers 25 into the post-treatment apparatus is to be substantially horizontal so that the sheet may be bent in an S-shape to be conveyed. As a result, the sheet end Pf temporarily discharged onto the sheet discharge tray 37 is raised in the direction spaced from the sheet discharge tray 37 (the arrow U direction), whereby the friction with the sheet already discharged onto the sheet discharge tray 37 may be reduced to prevent falloff in stacking ability.

Further, friction between the sheets is reduced so that contamination of the image formed surface can be also reduced.

In addition, high effects can be obtained in a simple configuration in which the conveying path of the sheet is formed to be in an S-shape, while the conveying path in the conventional apparatus is formed so as to convey the sheet substantially in the horizontal direction, thereby reducing the apparatus cost.

In the present embodiment, the sheet conveying speed of the pair of discharging rollers 23 and the pair of post-treatment discharging rollers 25 conveying the sheet is set such that the sheet conveying speed of the pair of post-treatment discharging rollers 25 is higher than the rotating speed of the pair of discharging rollers 23 at the time of conveying the sheet P to the post-treatment apparatus 46 to thereby place tension to the sheet between the fulcrums. This tension is directed downward on the pair of discharging rollers 23 as the fulcrum so that the force in the direction spaced from the sheet discharge tray 37 acts on the sheet end Pf which is the free end. This enables further effects to be obtained on improving stacking ability and preventing contamination.

Moreover, in the present embodiment, the pair of discharging rollers 23 and the pair of post-treatment discharging rollers 25 are used as the fulcrums S and S' shown in FIGS. 3 and 5. Regardless of the nip position of the pair of rollers, it is possible to place tension on the sheet with the fulcrums at guide portions G1 and G2 of an S-shaped guide as shown in FIG. 6. Namely, if it is possible to bend the sheet in an S-shape, the sheet discharged out of the apparatus can be raised, thereby enabling effects to be obtained such as preventing trailing of the sheet and contamination of the image surface.

The distance of the conveying path 24 between the pair of discharging rollers 23 and the pair of post-treatment discharging rollers 25 is set so as to be shorter than the length of the sheet in minimum size on which the image can be formed by the present image forming apparatus.

Next, the image forming apparatus according to the modification of the present invention will be described with reference to the drawings. The descriptions on the summary and the movement of the image forming apparatus 1 described in the above embodiment and on the component parts having the same configuration or the function as in the first embodiment will be omitted by referring to the components with the same reference numerals and characters.

Figure 7:
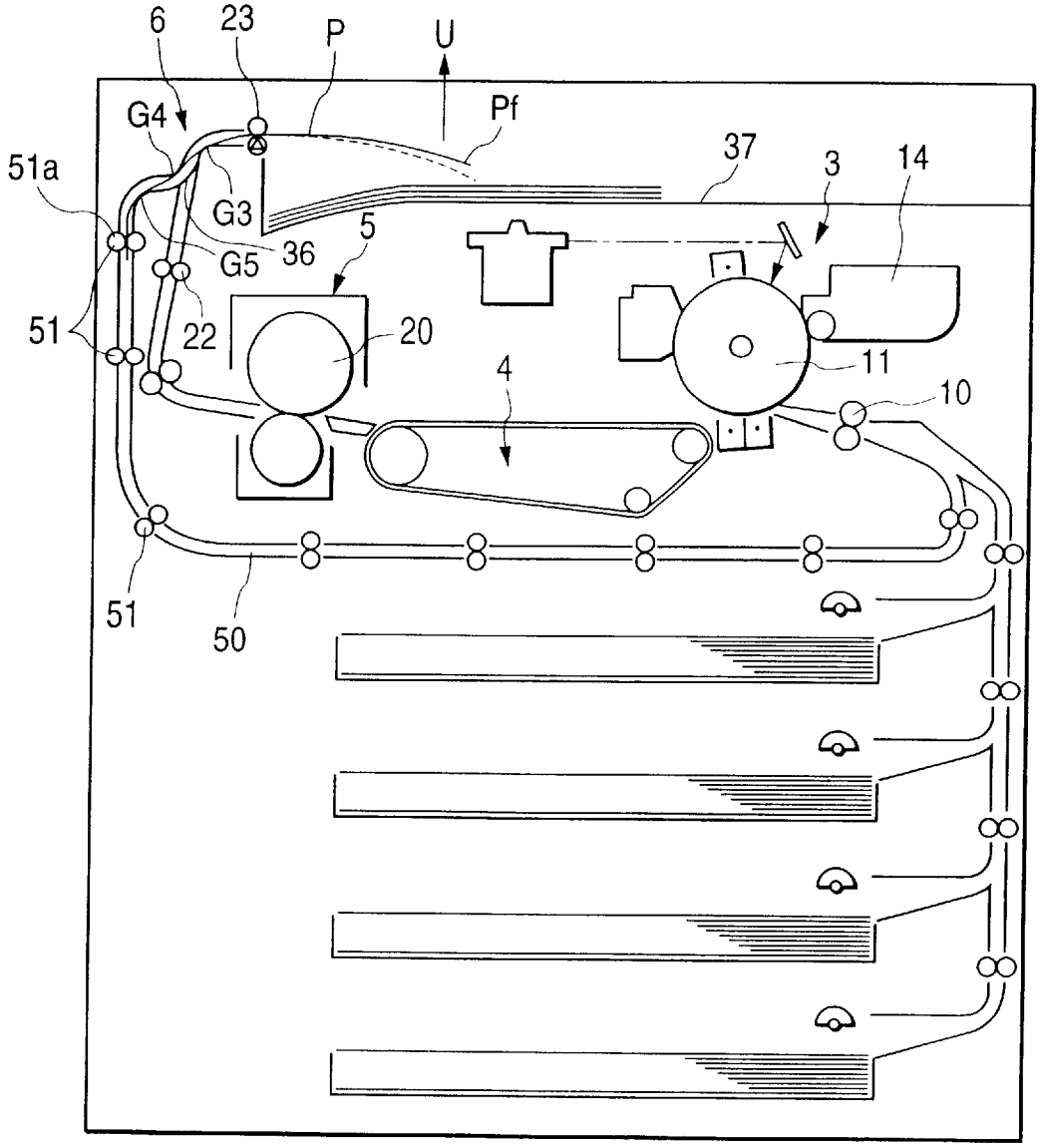
FIG. 7 is a schematic sectional view of an image forming apparatus according to a second embodiment of the present invention.

In FIG. 7, there is formed a double-sided path 50 for forming the image on both sides of the sheet in the image forming apparatus 1. The sheet P on which the image is formed, at one side thereof, at the image forming portion 3 passes through the fixing portion 5 and the sheet discharging portion 6 and discharged onto the sheet discharge tray 37 by the pair of discharging rollers 23. In case of forming the image on the other side of the sheet with no image, the pair of discharging rollers 23 is reversely rotated to turn over the discharging direction of the sheet with the sheet P nipped by the pair of discharging rollers 23.

The sheet P with its conveying direction turned over is guided by the flapper 36 to be fed into the 50. The sheet P is re-fed through a plurality of pairs of conveying rollers 51 to the upstream side of the pairs of registration rollers 10, and the image is formed on the other surface at the image forming portion 3.

In the present invention, the sheet P is deformed into an S-shape by forming the conveying path connecting the double-sided path 50 with the pair of discharging rollers 23 substantially in an S-shape, specifically, by pulling in the sheet P by the pair of conveying rollers 51 with fulcrums at the pair of discharging rollers 23 and sheet guide portions G3 and G5. Utilizing the rigidity of the sheet P at this time, the end Pf of the sheet, at the side of the sheet discharge tray 37, conveyed into the double-sided path 50 is raised in the arrow U direction. This reduces contact with the sheet already stacked and thereby prevents falloff of stacking ability. The friction between the sheets is reduced so that the contamination on the image formed surface can be also reduced.

In the case of the guide shape at the sheet discharging portion of the present configuration, the guide portion G4 is positioned on the line connecting the pair of discharging rollers 23 with the guide portion G5 or the line connecting the guide portions G5 and G3. Preferably, an S-shaped guide may be set such that the guide portion G4 protrudes beyond each lines described above.

The reason for adopting such a shape is in the conveying direction of the sheet in an S-shaped path. Namely, this is because of difference that, in the embodiment shown in FIG. 1, the sheet P conveyed into the post-treatment apparatus 46 by the pair of post-treatment discharging rollers 25 is conveyed substantially in the horizontal direction, while the sheet P fed through an S-shaped path into the double-sided path 50 in the present embodiment is conveyed substantially in the vertical direction.

In the above embodiment, the sheet P is conveyed substantially in the horizontal direction by the pair of post-treatment discharging rollers 25 as the fulcrums. This enables the sheet P to be deformed between the pair of discharging rollers 23 and the pair of post-treatment discharging rollers 25 as shown in FIG. 1 and the rigidity of the sheet to be utilized.

Figure 8:
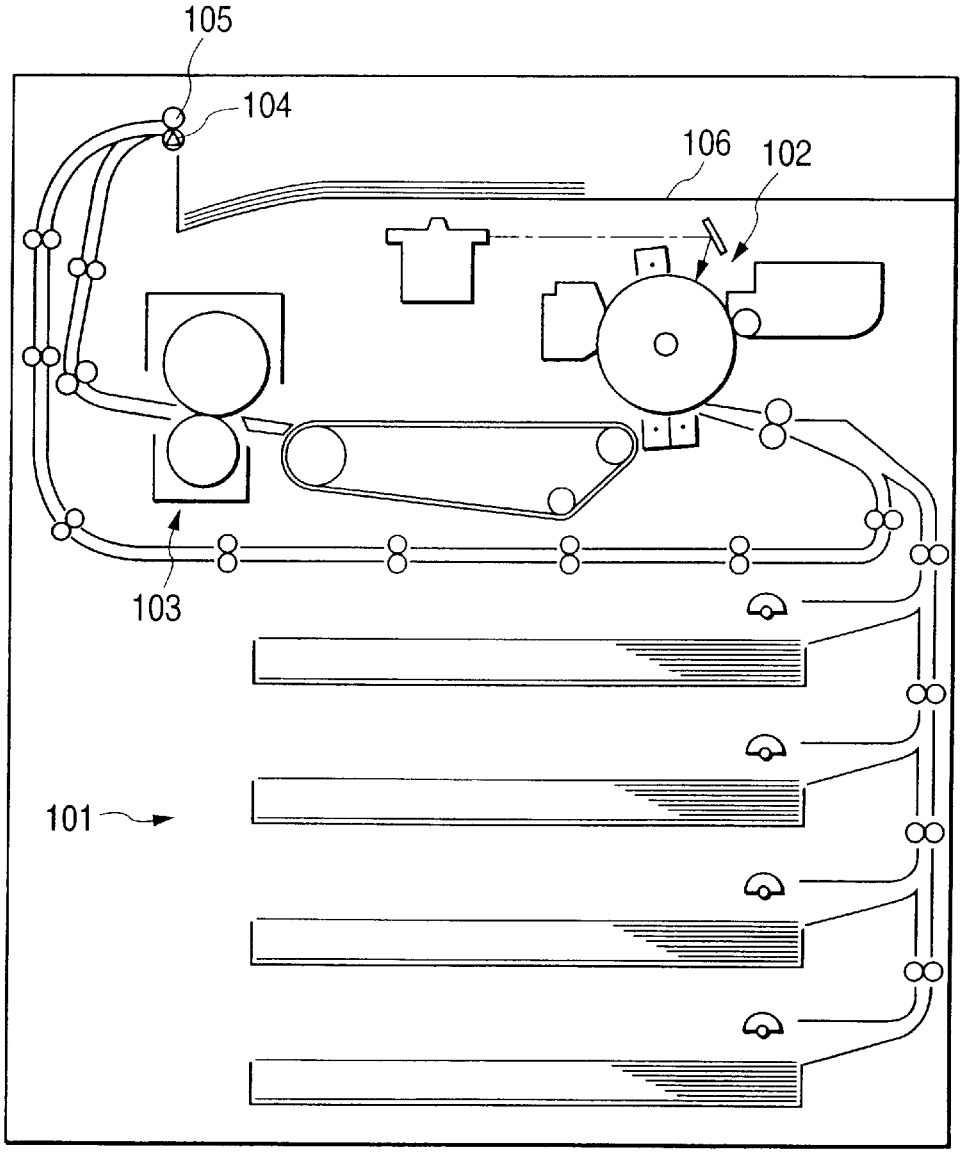
FIG. 8 is a schematic sectional view of an image forming apparatus having a conventional double-sided conveying path.
Figure 9:
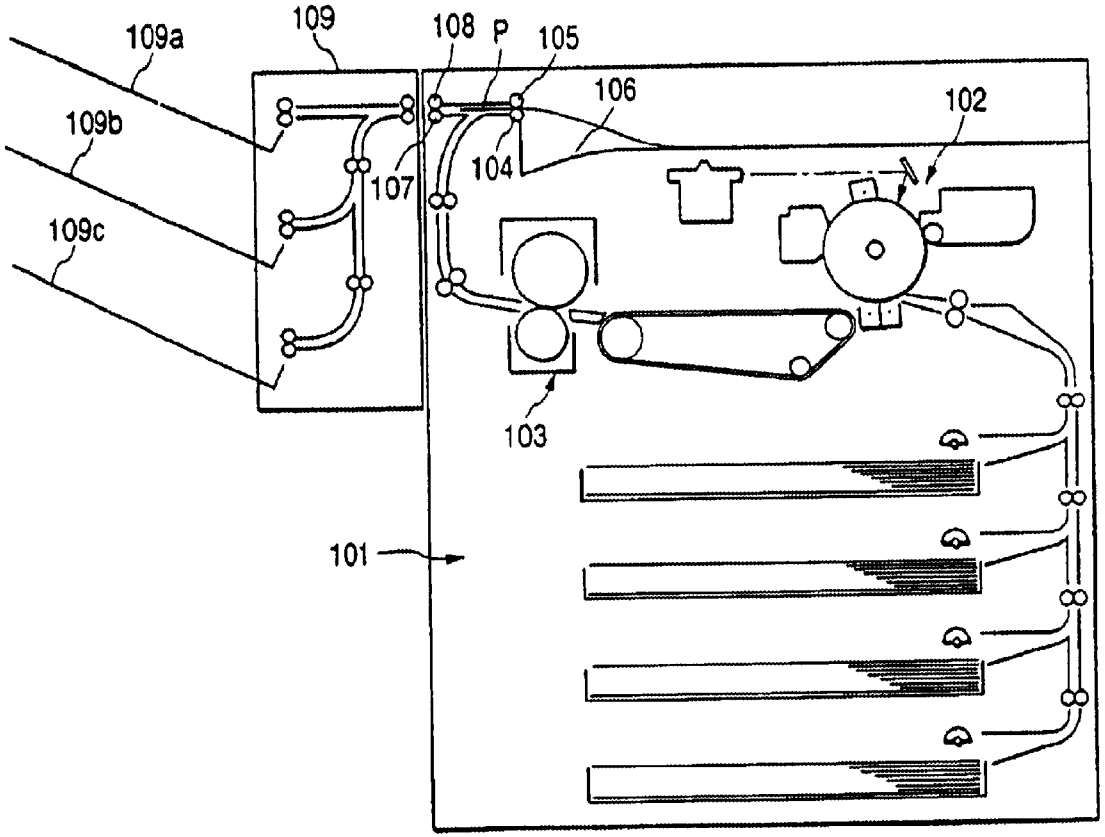
FIG. 9 PRIOR ART
FIG. 9 is a schematic sectional view of the image forming apparatus having a conventional post-treatment device conveying path.
Figure 10:
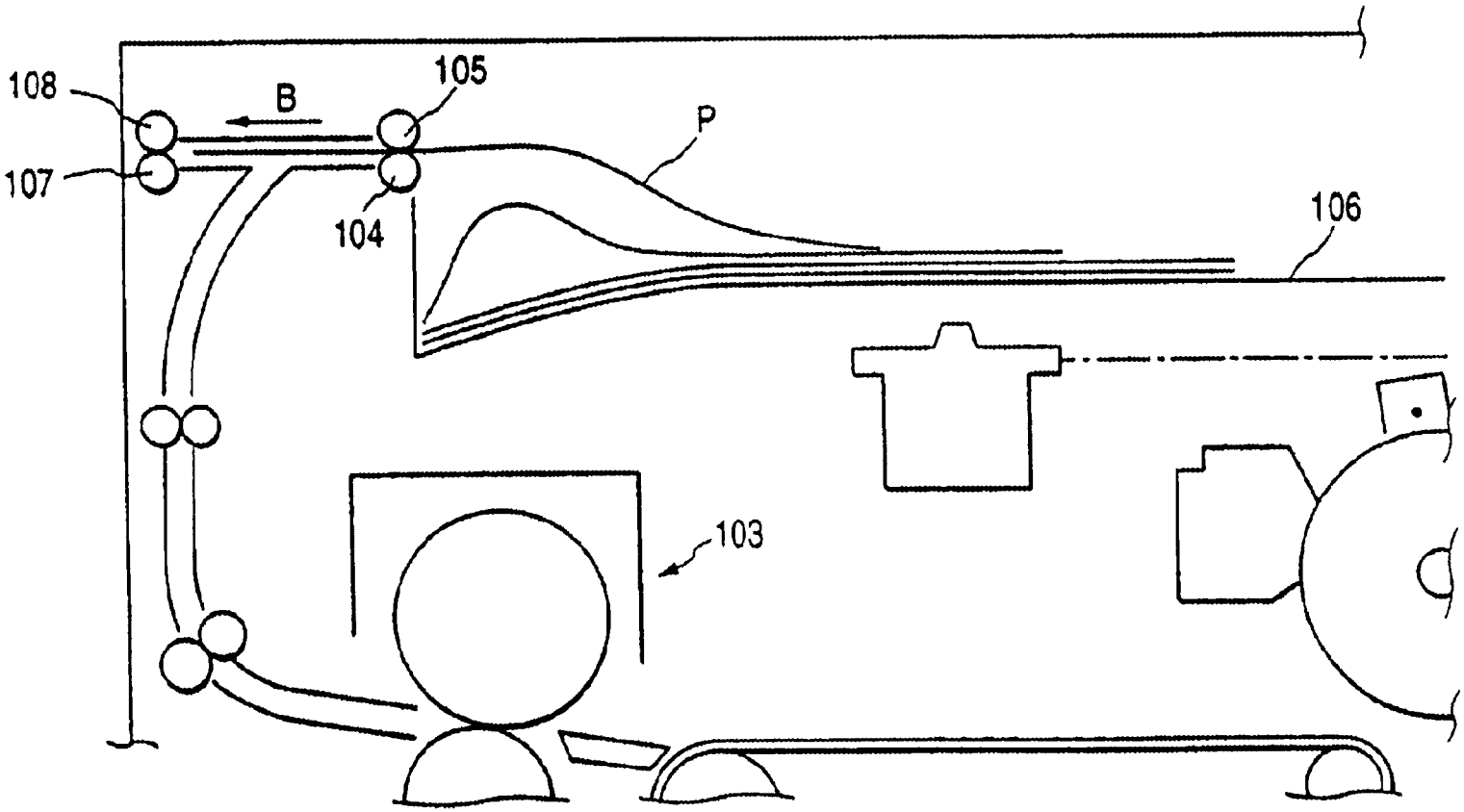
FIG. 10 PRIOR ART
FIG. 10 is a view showing condition of movement of discharging a sheet in a conventional apparatus shown in FIGS. 8 and 9.

As the present modification, however, when the sheet P is conveyed substantially in the vertical direction, the sheet P is pulled in from the pair of discharging rollers 23 inclinedly downward as shown in FIG. 8. This is the same as the principle shown in FIG. 2B and it is difficult to place a force in the arrow U direction on the sheet end Pf.

For this reason, the guide portion G4 is provided as a further fulcrum between the pair of discharging rollers 23 or the guide portion G3 and the guide portion G5 to pull in the sheet substantially in horizontal direction between the guide portions G4 and G5. This configuration enables the S: shaped path to be formed between the pair of discharging rollers 23 or the guide portions G3 and G4, and the sheet P to be conveyed substantially in the horizontal direction between the guide portions G4 and G5:, whereby a force can act on the sheet similar to the one in the principle shown in FIG. 3.

Accordingly, as compared with the case of not providing the guide portion G4, namely the case where the guide portion G4 does not cross the line connecting the pair of discharging rollers 23 and the guide portion G5 or the line connecting the guide portions G3 and the G5, the upward (the arrow U direction) force of the sheet end Pf may be increased, thereby obtaining higher effects.

As above-described with respect to the present invention, in the apparatus for repulling the sheet once discharged out of the apparatus into the apparatus, the conveying guide of the sheet to be pulled in is formed substantially in an S-shape so that contact with the sheet already stacked on the discharge tray is reduced, thereby preventing falloff of stacking ability of the sheet and contamination of the image formed surface.

In the present modification, the distance between the pair of conveying rollers 51*a* at the most upstream side of the double-sided path 50 and the pair of discharging rollers 23 is set to be shorter than the length of the sheet in minimum size on which the image can be formed. This enables the above described effects to be carried out on all the sheets and to be obtained such as preventing trailing and contamination.

As above-described, by adopting the present invention, in the apparatus in which the sheet discharged out of the apparatus is repulled into the image forming apparatus, the problems can be prevented caused by the pulled-in sheet contacting with the sheet already discharged and stacked.

Many widely different embodiments of the present invention may be constructed without departing from the spirit and scope of the present invention. It should be understood that the present invention is not limited to the specific embodiments described in the specification, except as defined in the appended claims.

What is claimed is:

1. An image forming apparatus, comprising:

image forming means for forming an image on a sheet;

a first conveying path through which the sheet on which the image is formed by said image forming means is conveyed;

a sheet discharge tray onto which the sheet conveyed through said first conveying path is discharged and accommodated facedown on said sheet discharge tray;

a sheet discharging roller rotatable in a direction of discharging the sheet onto said sheet discharge tray and in a reverse direction thereof; and a second conveying path extending downward from said sheet discharging roller at a first end of said second conveying path, with a section thereof formed in a substantially S-shape, wherein the sheet is conveyed in a direction of discharging the sheet onto said sheet discharge tray from said first conveying path by said sheet discharging roller and is pulled into said second conveying path by reversely rotating said sheet discharging roller during the sheet conveying, and thereby a leading edge of the sheet in the direction of discharging the sheet is raised in a direction spaced from said sheet discharge tray.

2. An image forming apparatus according to claim 1, wherein said second conveying path includes a conveying roller for conveying the sheet conveyed into said second conveying path and said second conveying path is formed so as to bend the sheet in a substantially S-shape between said sheet discharging roller and said conveying roller.

3. An image forming apparatus according to claim 1, wherein said second conveying path includes a first curve bending the sheet in a direction downward from said sheet discharging roller and, subsequent to the first curve, a second curve bending the sheet in a direction opposite to the direction of the first curve.

4. An image forming apparatus according to claim 1, wherein the sheet conveyed in said second conveying path is conveyed from a second end of said second conveying path to said double-sided conveying path.

5. An image forming apparatus according to claim 2, wherein said conveying roller is provided at a second end of said second conveying path and discharges the sheet conveyed in said second conveying path.

6. An image forming apparatus according to claim 5, wherein the sheet discharged by said conveying roller is conveyed to a post-treatment apparatus carrying out a predetermined post-treatment on the sheet discharged by said conveying roller.

7. An image forming apparatus according to claim 5, wherein the sheet discharged from said conveying roller is conveyed to a double-sided conveying unit in which the sheet discharged from said conveying roller is reconveyed to said image forming means so as to form the image on both sides of the sheet.

8. An image forming apparatus according to claim 5, wherein a sheet conveying speed of said conveying roller is higher than a speed at which said sheet discharging roller conveys the sheet in an opposite direction of discharging the sheet on said sheet discharge tray.

9. An image forming apparatus according to claim 3, wherein the sheet passed through the second curve is conveyed to a post-treatment apparatus carrying out a predetermined post-treatment on the sheet.

10. An image forming apparatus according to claim 3, wherein the sheet passed through the second curve is conveyed to a double-sided conveying path for forming the image on both sides of the sheet by an image forming means.

11. An image forming apparatus according to claim 4, wherein a sheet conveying speed of said conveying roller is higher than a speed at which said sheet discharging roller conveys the sheet in an opposite direction of discharging the sheet on said sheet discharge tray.

* * * * *

UNITED STATES PATENT AND TRADEMARK OFFICE

CERTIFICATE OF CORRECTION

PATENT NO. : 6,666,603 B1
DATED : December 23, 2003
INVENTOR(S) : Kenji Suzuki et al.

It is certified that error appears in the above-identified patent and that said Letters Patent is hereby corrected as shown below:

Column 1,
Line 56, “has” should read -- has the --.

Column 2,
Line 13, “temporality” should read -- temporarily --.

Column 3,
Line 4, “an” should read -- a --; and
Line 32, “a image:” should read -- an image --.

Column 4,
Line 46, “by, means” should read -- by means --.

Column 5,
Line 29, “tus.” should read -- tus 1. --.

Column 6,
Line 40, “U)” should read -- U --;
Line 52, “angel” should read -- angle --; and
Line 55, “ifs” should read -- is --.

Column 8,
Line 60, “lines” should read -- line --.

Column 9,
Line 19, “S:” should read -- S- --;
Line 23, “G5:,” should read -- G5 --; and
Line 45, “above described” should read -- above-described --.

UNITED STATES PATENT AND TRADEMARK OFFICE

CERTIFICATE OF CORRECTION

PATENT NO. : 6,666,603 B1
DATED : December 23, 2003
INVENTOR(S) : Kenji Suzuki et al.

It is certified that error appears in the above-identified patent and that said Letters Patent is hereby corrected as shown below:

Column 10,
Line 32, “to said” should read --to a --.

Signed and Sealed this

First Day of June, 2004

JON W. DUDAS
*Acting Director of the United States Patent and Trademark Office*